United States Patent [19]

Birkle et al.

[11] Patent Number: 4,668,367

[45] Date of Patent: May 26, 1987

[54] LOCK FOR LOADING AND UNLOADING GOODS INTO A TREATMENT APPARATUS HAVING A PROTECTIVE ATMOSPHERE

[75] Inventors: Siegfried Birkle, Höchstadt/Aisch; Johann Gehring, Spardorf, both of Fed. Rep. of Germany

[73] Assignee: Siemens Aktiengesellschaft, Berlin & Munich, Fed. Rep. of Germany

[21] Appl. No.: 880,077

[22] Filed: Jun. 30, 1986

[30] Foreign Application Priority Data

Jul. 9, 1985 [DE] Fed. Rep. of Germany ..... 3524479

[51] Int. Cl.[4] ..... C25D 17/00

[52] U.S. Cl. ..... 204/275

[58] Field of Search ..... 204/194, 275, 277, 278

[56] References Cited

U.S. PATENT DOCUMENTS

| | | | |
|---|---|---|---|
| 3,868,213 | 2/1975 | Shulika et al. | 432/134 |
| 4,091,826 | 5/1978 | Bahrke | 134/11 |
| 4,265,726 | 5/1981 | Herrnring et al. | 204/202 |
| 4,427,518 | 1/1984 | de Vries et al. | 204/201 |

FOREIGN PATENT DOCUMENTS

| | | | |
|---|---|---|---|
| 0070011 | 1/1983 | European Pat. Off. | 204/201 |
| 0013874 | 3/1984 | European Pat. Off. | 204/202 |
| 2914868 | 10/1980 | Fed. Rep. of Germany | 204/275 |
| 2318945 | 2/1977 | France | 134/11 |

*Primary Examiner*—T. M. Tufariello

*Attorney, Agent, or Firm*—Hill, Van Santen, Steadman & Simpson

[57] ABSTRACT

A lock for loading and unloading a treatment apparatus with bulk goods characterized by at least one U-shaped lock chamber fillable with inert fluid and chargeable with inert gas. To transport the goods through the ascending portion of the U-shaped lock, the lock has a vibratory conveyor comprising a helically ascending conveyor track which can be either a separate track in a chamber or can be formed by a floor of a helically ascending lock chamber. To form the vibratory conveyor, either the helically ascending lock chamber or the helically ascending conveyor is connected to a vibrator preferably through a central column.

24 Claims, 4 Drawing Figures

LOCK FOR LOADING AND UNLOADING GOODS INTO A TREATMENT APPARATUS HAVING A PROTECTIVE ATMOSPHERE

BACKGROUND OF THE INVENTION

The present invention is directed to a lock for loading and unloading a treatment facility for bulk material operating under an air exclusion or protective atmosphere and particularly for an apparatus for electrodeposition of aluminum from an aprotic, oxygen-free and water-free, aluminum-organic electrolyte. The lock comprises at least one U-shaped lock chamber fillable with an inert fluid and chargeable with inert gas, and a conveying means for conducting a bulk material through the lock along a defined conveyor path.

Aluminum deposited from aprotic, oxygen-free and water-free, aluminum-organic electrolyte is distinguished by its ductility, low number of pores, corrosion resistance and ability to be anodized. Since, due to the reaction with atmospheric oxygen and atmospheric humidity, the access of air effects a considerable reduction in the conductivity and in the useful life of the electrolytes, the electro-plating must be undertaken in a treatment facility or apparatus working under air exclusion or a protective atmosphere. Pretreatment baths required for the surface pretreatment of the material to be electro-plated and after treatment baths required for freeing the aluminized material from electrolyte residues and/or hydrolysis products are likewise maintained in a treatment apparatus operating under a protective atmosphere or air exclusion. Other examples of applications for such treatment facilities, which are closeable and air-tight, are galvanizing, polishing and cleaning processes, wherein the corresponding baths develop, for example, toxic or explosive gasses or produces gasses or vapors which jeopardize the environment in some other way. In order to prevent the access of air or the emission of gasses or vapors when loading and unloading, these treatment apparatuses or facilities operate under an air exclusion and require admission and discharge locks, which are constructed as gas locks, as liquid locks or as a combination gas and liquid lock. These locks are also provided with conveying means for conducting the material to be treated through the lock.

European Patent Application No. 00 13 874 discloses a facility operating under air exclusion for the electrodeposition of aluminum from an aprotic, oxygen-free and water-free, aluminum-organic electrolyte, wherein the material to be aluminized is introduced into an electro-plating tank containing the electrolyte through a liquid lock and is, in turn, likewise removed through a liquid lock. The liquid lock is composed of a U-shaped lock chamber filled with an inert fluid, which is preceded at an admission side of the lock by an antechamber provided with a door, which can be closed gas-tight and which chamber contains an inert gas. For the purpose of loading the apparatus, racks carrying the goods, which are to be electro-plated, are introduced into the antechamber by the door which closes gas-tight and are then suspended from a conveyor means, which comprises two endless conveying chains. During inward transfer, the racks of goods then traverse the antechamber and the lock chamber filled with the inert fluid and the inert gas space arranged in the electro-plating tank above the electrolyte level whereupon they are immersed into the electrolyte. The discharge of the goods at the discharge lock occurs in a reverse direction after the aluminization process.

The lock of this known facility is equipped with an involved and complicated conveyor means which, moreover, only allows throughput of racks of goods. Racks of goods, however, are uneconomical for aluminum-plating bulk materials such as bolts, nuts, screws, spacer bushings and the like because of the loading of these goods to be aluminum-plated into the racks would be extremely work intensive and, therefore, extremely expensive.

U.S. Pat. No. 4,427,518, which claims priority from the same German application as European Patent No. 00 70 011, discloses another apparatus operating under the air exlcusion for the electro-depositing of aluminum from an aprotic, oxygen-free and water-free, aluminum-organic electrolyte. As disclosed in this patent, which is incorporated by reference thereto, the apparatus includes an electro-plating drum, which is arranged in a rotatable fashion in an electro-plating tank having an introduction liquid lock and a discharge lock, which is also a liquid lock. The goods, which are to be aluminized, are introduced into the electro-plating drum by first being introduced through the admission or introduction lock and after traversing the electro-plating drum, which is provided with a helical rib on the inside wall as the conveying means, are then discharged through the discharge lock. The material to be aluminized is introduced into the admission lock, which has an admission funnel that discharges onto a conveyor belt which conveys the goods through the admission lock and discharges them into a funnel which discharges into the beginning or front end of the electroplating drum. At the back end of the electro-plating drum, a conveyor belt, which begins under the electrolyte level has another end that extends above the electrolyte level. The upper end of this conveyor belt discharges the goods into a funnel-shaped part which discharges onto a portion of another conveyor belt which dips into an inert fluid. This second or other conveyor belt ends above the inert fluid level and discharges through another funnel-shaped outlet nozzle. This known facility has the advantage that bulk goods can be aluminum-plated in a continuous process without having to be loaded into racks for goods. The conveying means for conducting aluminized material through the admission lock and the discharge lock, however, also are relatively complicated. Moreover, the use of conveyor belts requires a seal for the drive shafts which must be conducted out of the lock and the seals for the rotating parts can be difficult to produce due to the high demands that will occur with the particular liquids being utilized.

SUMMARY OF THE INVENTION

The present invention is directed to creating a lock for loading and unloading a treatment facility for bulk material which lock operates under the exclusion of air and has conveyor means which are utilized for the conveying of the goods through the lock, does not require any sealing of rotating parts and guarantees a gentle conveying of the bulk material.

In a lock of this type, the object is achieved in that the bulk materials are transportable through an ascending leg of a U-shaped lock chamber by means of a vibratory conveyor comprising a helically upward leading conveyor path. Vibratory conveyors are conveyor means which will transport the bulk on a defined conveying path in a horizontal and/or oblique direction upon exploitation of the forces of gravity. Obliquely acting vibrators or obliquely placed connecting rods usually serve as drive means for the conveyor. These drive means place the conveyor path in vibration so that the material executes mainly micro-projectile motion and is thereby transported in the conveying direction with a gain of height. The use of a vibratory conveyor comprising helical-shaped conveying path in a treatment facility operating under air exclusion are known from the French Pat. No. A2 318 915, the German Pat. No. 2 914 864 and the U.S. Pat. No. 3,868,213.

The invention is based on the perception that such a vibratory conveyor employed as a conveying means in a lock will not raise any problems regarding the sealing and, moreover, enables an extremely gentle conveying of the bulk goods whereby jamming of the conveyed goods need not be feared. Due to the vibration of the vibratory conveyor, the entrainment of gasses or vapors into the treatment facility on the goods is reliably excluded as the goods are conveyed through the inert fluid. Moreover, the drops of the inert fluid still adhering to the surfaces of the goods above the inert fluid level, which is charged with inert gas, will be hurled off the surface by the vibrations so that the extremely low entrainment of inert fluid will occur.

The conveying path is preferably fashioned as a vibratory conveyor which guarantees a reliable guidance of the material to be carried with a low outlay.

In accordance with the particular preferred development of the invention, the conveying path is formed by a floor of a helically upward leading lock chamber. The conveying path thus, forms an integral component of the lock chamber, which preferably comprises a rectangular cross section. Since practically the only thing still required for conveying the bulk material is a vibration exciter for the lock chamber, the lock can be realized with a minimum cost. The problem of sealing the drive parts on the conveyor means is completely eliminated.

When conveying bulk material with the helically ascending conveyor path, it can be advantageous under certain conditions when the inert fluid flow influences the bulk material in the conveying direction. Thus, the flow of the inert fluid is generated in the region of the lock chamber with the assistance of a circulating pump and directed in the direction of the flow of goods through the conveyor. In this case, the dampening of the conveyor by the inert fluid is opposed and the promotion of the conveying with the inert fluid flow is successfully achieved.

When the lock chamber is fastened to a centrally arranged support column, then the support column can serve both as a carrying structure of the helically ascending lock chamber as well as for the transmission of vibrations thereto. The vibration creation is effected in a simple manner in that the supporting column is arranged on a vibrator or carries a vibrator. The vibrator is then expediently equipped with an unbalanced drive. When the unbalanced drive comprises at least one flywheel which has an adjustable eccentricity, then the parameters of the conveying can be easily optimized and adapted to the respective peculiarities of the particular material being conveyed.

The feed of the bulk material to the vibratory conveyor can be particularly easily realized when the vibratory conveyor is preceded by a gravity conveyor as seen in the conveying direction. The same advantages also occur when the vibratory conveyor is followed by a gravity conveyor as seen in the conveying direction. In both cases, it is particularly desireable in view of the sealing of the lock when the gravity conveyor is formed by a downpipe. The gravity conveyor is then incorporated into the lock region i.e. it is employed as a downwardly leading leg of a U-shaped liquid lock.

It is also expedient when the gravity conveyor can be closed gas-tight by a cover at either the input side or outlet side. When at least that region of the gravity conveyor lying above or below the cover can be covered with inert gas, then this region can assume the function of the chamber preceding a liquid lock or, respectively, following the liquid lock in a very simple way. In order to obtain a compensation between the stationarily situated parts of the lock and vibrationally seated parts of the lock and in order to avoid the danger of fatique fractures, it is also expedient when the gravity conveyor includes an interposed compensator which allows movement between two parts. In the case of an interposed compensator, one part of the gravity conveyor is thereby stationarily arranged, and the other part is excited by the vibration required for conveying the bulk material.

Further improvements in the conveying can, under given conditions, also be achieved in that an end region of the conveyor path of the vibratory conveyor comprises a roughened or profiled surface or a surface which has a friction coating. As a result of these measures, the static friction between conveying track and the material to be conveyed is boosted to such a degree that a reliably conveying and a complete emptying of the lock is guaranteed in every instance.

Given employment of a highly volatile inert fluid, such as toluol and the like, it is also desireable that the lock zones are filled with the inert fluid is followed by at least one cooling zone as seen in the conveying direction. This cooling zone is preferably formed by cooling pipes. Thus, the vapors ascending from the inert fluid will be condensed in the region of the cooling zone and are returned as a condensate. Thus, the loss of the inert fluid can be kept especially low.

DESCRIPTION OF THE PREFERRED EMBODIMENTS

Figure 1:
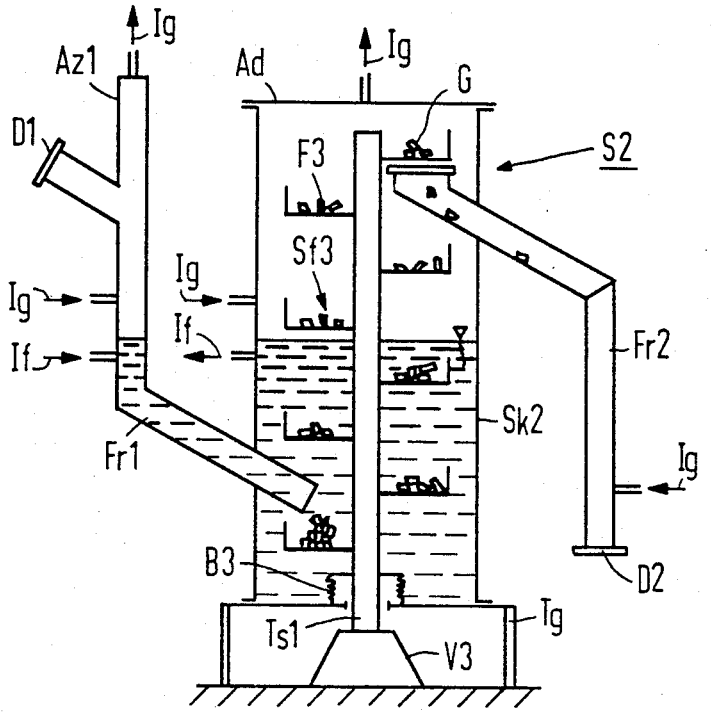
FIG. 1 is a schematic cross sectional view with portions in elevation for purposes of illustration of an admission lock in accordance with the present invention having a helically vibrating conveyor utilized in an apparatus for electro-depositing of aluminum.

The principles of the present invention are particularly useful in a lock generally indicated at S2 in FIG. 1. The lock S2 as illustrated can be used as an admission lock or discharge lock for an apparatus or facility, which is not shown in the drawings, for electro-depositing aluminum from an aprotic, oxygen-free and water-free, aluminum-organic electrolyte.

The bulk goods G, which are to be aluminized and can be bolts, nuts, spacer bushings and the like, are introduced at the admission lock side by being introduced into a downpipe Fr1, which can be closed gas-tight by a cover D1 and has a lower end discharging into a lower region of a lock chamber or tank Sk2 partially filled with inert fluid, such as, for example, toluol. Since the downpipe Fr1 and the cylindrical lock chamber Sk2 are communicating conduits, the principle of a U-shaped lock is obtained. An inert fluid flow directed essentially in the conveying direction of the bulk goods G is generated within the liquid lock with the assistance of a circulating pump (not shown in the drawings), which discharges fluid through an inlet in the downpipe Fr1 as indicated by the arrow If and removes liquid from the chamber Sk2 from an oulet as indicated by the arrow If. The region of the downpipe Fr1 lying below the cover D1 and above the inert fluid level is charged with inert gas, such as, for example, nitrogen, and this inert gas is fed through an inlet positioned above the inert fluid level. A discharge of the inert gas from a vertical branch Azl of the, downpipe Fr1, which has a discharge outlet, is illustrated by the arrows Ig. The chamber Sk2 has a lid or cover Ad with an outlet for inert gas and the chamber also has an inlet positioned above the fluid level for admitting the inert gas.

The bulk goods G, which are introduced by the downpipe Fr1, will fall on the lower end of a conveyor track F3 of a vibratory conveyor which is generally indicated at Sf3 and is arranged within the lock chamber Sk2. On the conveyor track F3, which is fashioned as a vibrating conveyor which helically ascends in the conveying direction, the goods G are conveyed up above the inert fluid level and are then discharged to fall into the upper, funnel like end of a downpipe Fr2 which leads out of the lock chamber Sk2. The downpipe Fr2 has a lower end which is closed gas-tight by a cover D2. When the lock S2 is used as an admission lock and the lower end of the downpipe Fr2 discharges into electro-plating facility working under air exclusion or protective atmosphere, the cover D2 can be ommitted. The region of the lock chamber Sk2 lying above the inert fluid level as mentioned hereinabove and also the downpipe Fr2 are charged with the inert gas, such as, for example, nitrogen. On a sub-section of the conveyor path leading through the inert gas zone, the drops of inert fluid still adhering to the bulk goods G are hurled off by the vibration of the conveyor track F3 so that only an extremely slight entrainment of the inert fluid If out of the lock chamber Sk2 will occur.

The conveying track F3, which is fashioned as a vibrating conveyor that ascends helically within the lock chamber Sk2, is fastened to a centrally arranged carrying column Ts1 whose lower end is fastened to a vibrator V3 which is centrally arranged within the machine frame Tg of the lock chamber Sk2. The passage of the carrying column Ts1 through the floor of the lock chamber Sk2 is sealed by an elastic bellows B3, which is connected at one end to a disk carried by the carrying column Ts3 and to the floor at the other end. Due to the vibrator V3, the conveyor track F3 is excited via the carrying column Ts1 to execute vibrations having a roughly helical movement. Due to the canted motion and the accelerations and the speeds thereby occurring, a canted projectile motion is impressed on the goods G lying on the helically ascending conveyor track F3 so that the bulk goods are transported in a conveying direction while gaining height. Since the projectile distance and the projectile height is extremely slight, this type of conveying involves a micro-projectile motion conveying which guarantees an extremely gentle treatment of the goods to be passed through the lock.

Figure 2:
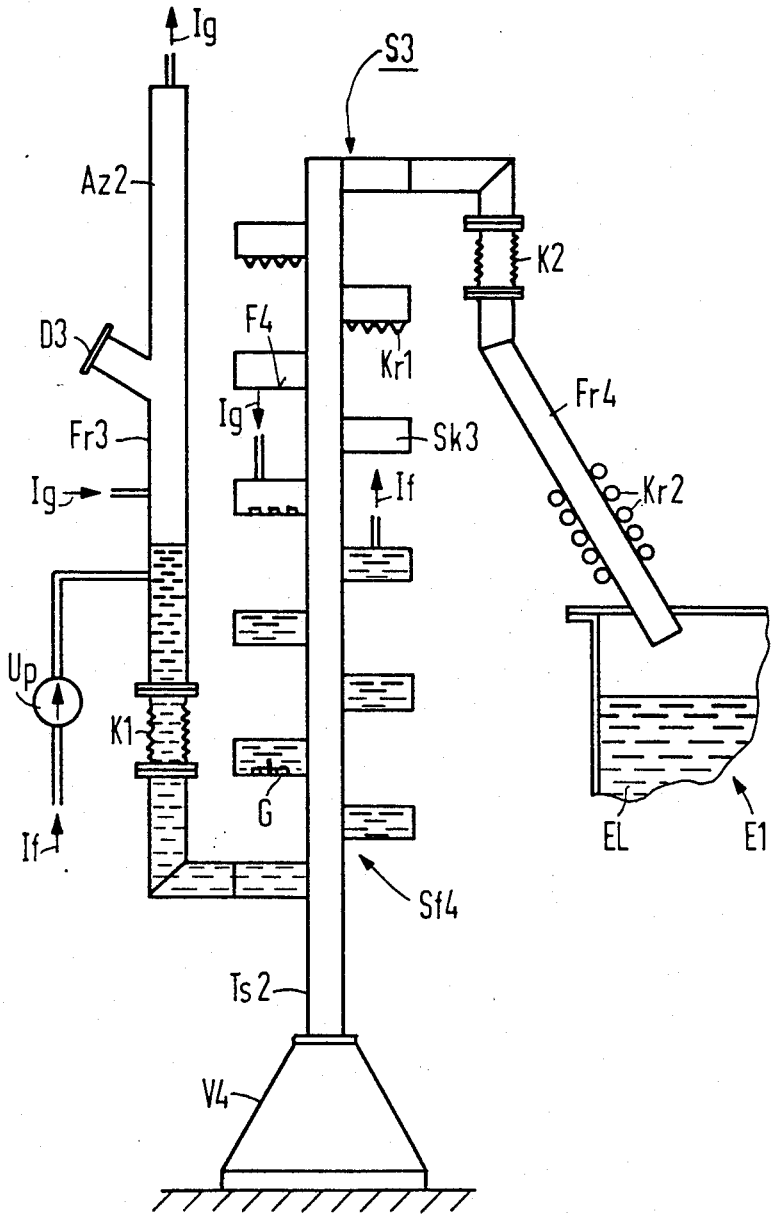
FIG. 2 is a schematic cross sectional view of another embodiment of an admission lock in accordance with the present invention utilizing a helical lock chamber being used with an apparatus for electro-depositing aluminum.

In FIG. 2, a lock generally indicated at S3 serves as an admission lock for a facility E1 (only a portion is shown) for electro-depositing aluminum from aprotic, oxygen-free and water-free, aluminum-organic electrolyte EL.

The goods G, which are to aluminized, are introduced at the lock admission side into a downpipe Fr3 which is closeable gas-tight by a cover D3 and has a lower end of the discharging into a helically ascending lock chamber Sk3 which is partially filled with an inert fluid, for example, toluol. Since the downpipe Fr3 and the lock chamber Sk3 comprising a rectangular cross section are a matter of communicating conduits, the principle of a U-shaped liquid lock is obtained. An inert fluid flow directed in the conveying direction of the bulk goods is generated within this liquid lock with the assistance of a circulating pump Up whereby the circulation of the inert fluid is indicated by arrow If as it flows through the pump into an inlet in the downpipe Fr3 and out an outlet in the ascending lock chamber Sk3. The region of the downpipe Fr3 lying below the cover D3 and above the inert fluid level is charged with an inert gas, for example, nitrogen, and the feed of this inert gas occurs just above the inert fluid level and the elimination of the inert gas is through an outlet in a vertical branch Az2 of the downpipe Fr3 as shown by the arrows Ig.

The bulk goods G introduced by the downpipe Fr3 thus, proceed to a lower end of the lock chamber Sk3, whose floor simultaneously acts as a helically ascending conveyor track F4 of a vibratory conveyor which is generally indicated as Sf4. In the lock chamber Sk3, the goods G are transported up on the conveyor track F4 above the inert fluid level and then proceed into a downpipe Fr4 immediately connected to an upper end of the lock chamber Sk3. The lower end of the downpipe Fr4 discharges into the space of the facility or apparatus E1 charged with an inert gas above the electrolyte EL. The region of the lock chamber Sk3 lying above the inert fluid level and the downpipe Fr4 are charge with inert gas, for example, nitrogen, which is fed into an inlet as indicated by the arrow Ig and is eliminated through the apparatus E1 by an outlet (not illustrated).

On the sub-section of the conveyor path leading through the inert gas zone of the lock chamber Sk3, the drops of the inert fluid still adhering to the bulk goods G are hurled off by the vibrations of the conveyor track F4 and run back into the fluid zone. Thus, an extremely slight entrainment of the inert fluid If into the electrolyte EL will occur. In addition, vapors also occurring from the inert fluid If are condensed in a cooling zone before entering into the downpipe Fr4 so that it will also flow back into the inert fluid If as a condensate. This cooling zone is formed by cooling pipes Kr1, which are attached in the region of the upper turns of the helical lock chamber on the outer surface of the members forming the floor of the helical lock chamber Sk3. Vapors rising from the electrolyte EL into the donwpipe Fr4 are condensed in a second cooling zone so that they will run back into the electrolyte EL as a condensate. This second cooling zone is formed by a cooling pipe Kr2, which is helically wrapped around the lower portion of the downpipe Fr4.

The helically ascending lock chamber Sk3 is fastened to a centrally arranged carrying column Ts 3 whose lower end is arranged on a vibrator V4. Due to the vibrator V4, the overall lock chamber Sk3 is excited via the carrying column Ts2 to vibrations having a roughly helical motion so that the bulk goods G on the conveyor track F4 are transported up by means of micro-projectile motion conveying. Since a region or portion of the downpipe Fr3 and Fr4 immediately adjacent the lock chamber Sk3 likewise have a conveying vibrations imposed upon them, their connection to the stationary arranged downpipe regions occurs via elastic compensators K1 and K2, respectively.

Figure 3:
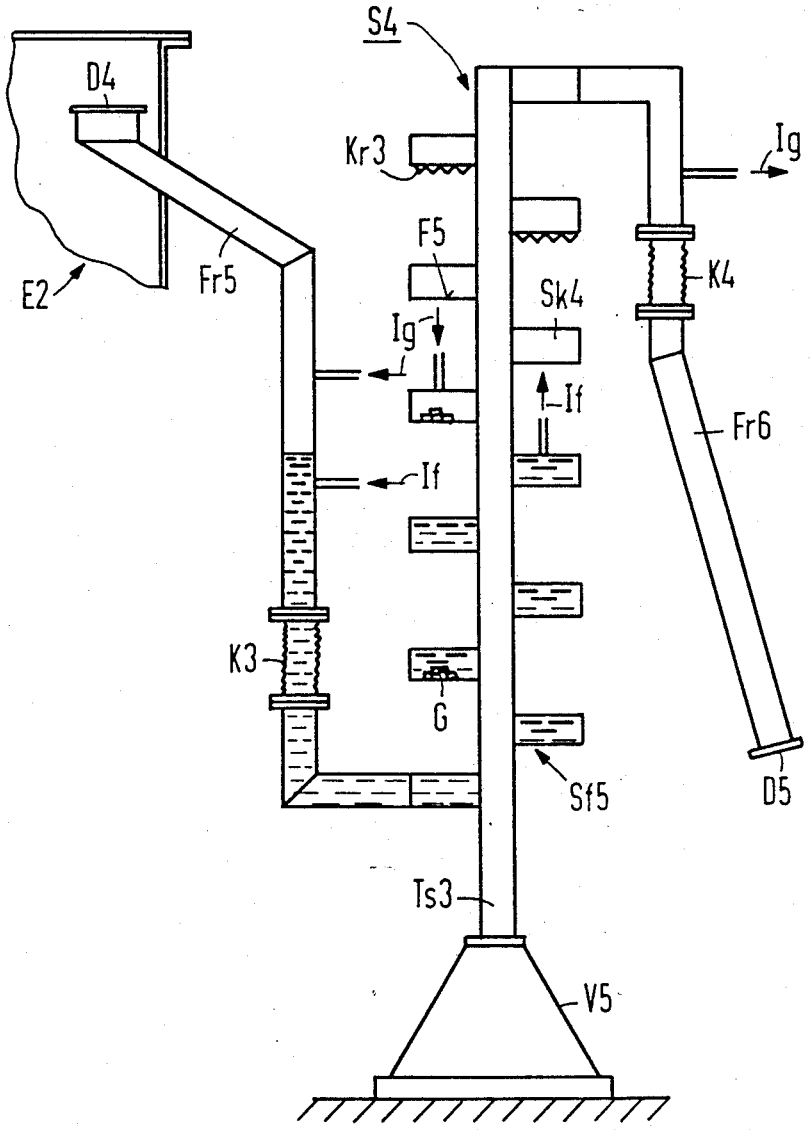
FIG. 3 is a schematic cross sectional view of a discharge lock equipped with a helical lock chamber acting as a discharge in an apparatus for electro-deposition of aluminum.

A lock, generally indicated at S4 in FIG. 3, serves as a discharge lock for an apparatus or facility E2, which is only partially shown, and which may be either an apparatus for electro-depositing of aluminum from an aprotic, oxygen-free and water-free, aluminum-organic electrolyte or an after treatment apparatus for the aluminized goods G which apparatus operates under a protective atmosphere or with the exclusion of air. The goods G aluminized or after treated in the apparatus E2 are introduced into a funnel-shaped, upper end of a downpipe Fr5 which upper end is located in the apparatus E2 and is closeable gas-tight with a cover D4. This downpipe Fr5, which is conducted towards the outside and is equipped with an interposed elastic compensator K3, discharges into a lower end of a helically ascending lock chamber Sk4, which is partially filled with an inert fluid, such as toluol. Since the downpipe Fr5 and the lock chamber Sk4, which has a rectangular cross section, are communicating conduits, the principle of a U-shaped liquid lock is also obtained. An inert fluid flow directed in the conveying direction of the goods G is generated within the liquid with the assistance of a circulating pump (not shown) that discharges into an inlet into the downpipe Fr5 and has an outlet connected to the pump in the helically lock chamber Sk4. The flow is shown by the arrows If. The region of the downpipe Fr5 lying above the inert fluid level is charged with an inert gas, for example, nitrogen, and the feed of this inert gas is introduced just above the liquid level as indicated by an inlet and the arrow Ig.

The goods G introduced via the downpipe Fr2 thus proceed into the lower end of the lock chamber Sk4, whose floor simultaneously acts as a helically ascending conveyor track F5 of a vibratory conveyor generally indicated at Sf5. The lock chamber Sk4 is secured to a centrally arranged carrying column Ts3 whose lower end is arranged on a vibratory V5. Due to this vibrator V5, the overall lock chamber Sk4 is placed in vibration via the carrying column Ts3 and the bulk goods are thus transported by means of a micro-projectile motion to be conveyed above the liquid level and proceed into a downpipe Fr6 which is connected to an upper end of the lock chamber Sk4. The lower end of the downpipe Fr6 is equipped with an intervening elastic compensator K4 and is closeable gas-tight with a cover D5. In order to prevent the entry of air into the lock S4 upon removal of the bulk goods given a removal of the open cover D5, the region of the lock chamber Sk4 lying above the inert liquid level and the downpipe Fr6 are each charged with inert gas, for example nitrogen, with the feed of this inert gas into an inlet in the lock chamber.Sk4 and its removal through an outlet in the downpipe Fr6 being indicated by arrows Ig. The inert gas zone of the lock chamber Sk4 here again acts as a drying zone because of vibrations transmitted to the bulk goods will cause drops of the inert fluid which are still adhering to the goods to be hurled off in this zone. In addition, cooling pipes Kr3 are attached on the outside surface of the floor plates in the upper turns of the lock chamber Sk4. These cooling pipes Kr3 form a cooling zone for the condensing vapors which rise out of the inert liquid If.

Figure 4:
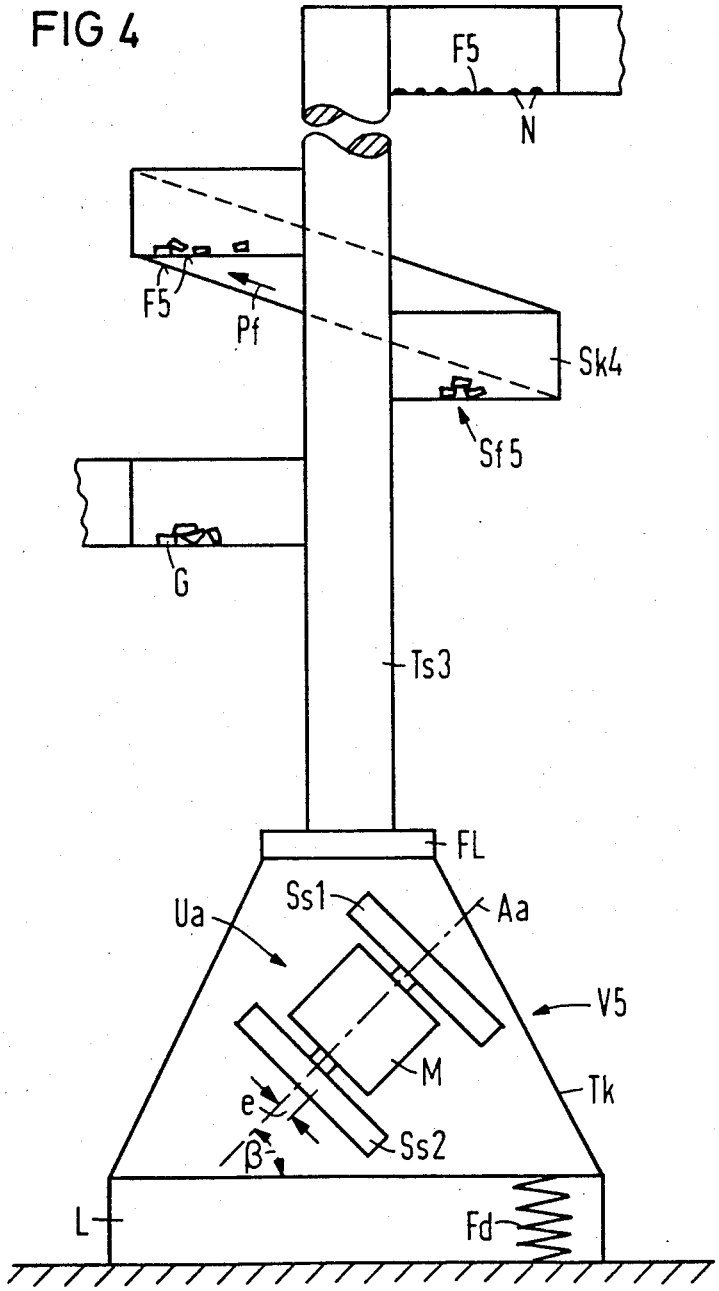
FIG. 4 is a detailed view of a vibrator used with a discharge lock of FIG. 3.

The vibrator V5, which is used with the lock S4 is shown in greater detail in FIG. 4 and functions principally with the vibrations being created by means of an unbalanced drive generally indicated at Ua. The vibration excitation of the vibratory conveyor Sf5 will occur via the carrying column Ts3 which carries the lock chamber Sk4. This carrying column Ts3 is rigidly connected via a flange FL to a downwardly, conically expanding carrier member Tk of the vibrator V5. The carrier member Tk is vibrationally seated on a bearing L, which is formed, for example, by a plurality of springs Fd, only one being illustrated.

The unbalanced drive Ua is arranged within the conical carrier member Tk and includes a motor M having a drive shaft Aa on which disk flywheels Ss1 and Ss2 are mounted with adjustable eccentricity e. The drive shaft Aa of the motor M is inclined at an angle $\beta$, for example, 45° relative to a horizontal plane. The overall vibrational system is then placed in vibration by the unbalance of the disk flywheels Ss1 and Ss2 so that the accelerating forces exerted on the bulk goods G effect a micro-projectile motion conveying along the conveyor track F5, which is helically ascending in a right-hand turn, as indicated by the arrow Pf. The adjustment of the eccentricity e, which, for example, can be undertaken via the double eccentrics, thereby enables an optimization of the micro-projectile motion conveying of the bulk goods G. The rising angle of the helically ascending conveying track F5 is selected so that the bulk goods G no longer slide down or so that the conveying of the essentially micro-projectile motion is greater than the back-slide and a useful conveying is still present.

It has been observed that a useful conveying in the region of the upper turns of the conveyor track F5 may potentially also be arrested when goods G to be resupplied from below are no longer present. In order to make this hazard impossible from the very outset, the static friction between the goods G to be conveyed and the conveyor track F5 can be increased in this upper region. This is indicated in FIG. 4 by a conveying track F5 which has been provided with naps N.

The locks which comprises the helically ascending conveyor track shown in FIGS. 1, 2 and 3, have a particular advantage because they can be constructed as U-shaped liquid locks giving a space saving and compact structure. Numerous variations are possible for the arrangement and execution of the conveyor track and for the vibrational excitation of the conveyor track. Thus, for example, the helical conveyor track in the exemplary embodiment shown in FIG. 1 can also be arranged in the frame fashioned truss-like and having an annular floor plan, hereby replacement conveyor track segments are secured to radially directed rods of the frame in view of a potential wear. The frame is in turn connected to the carrier plate seated vibrationally in the lock chamber via, for example, springs and this carrier plate is excited via the vibrator likewise arranged within the lock chamber. The problems of sealing drive parts of the conveyor means is thereby completely eliminated. Given the locks shown in FIGS. 1, 2 and 3, the carrying column can also be erected on vibrationally seated carrying plates and can be excited via vibrators arranged at their upper end. In the exemplary embodiment of FIG. 1, both the carrier plates as well as the vibrator are then incorporated into the lock chamber so that the bellows shown in the drawings can be eliminated.

Although various minor modifications may be suggested by those versed in the art, it should be understood that we wish to embody with the scope of the patent granted hereon, all such modifications as reasonably and properly come within the scope of our contribution to the art.

We claim:

1. In a lock for loading and unloading goods from a treatment apparatus operating under a protective atmosphere, said lock comprising at least one U-shaped lock chamber fillable with an inert fluid and chargeable with inert gas and conveying means for conducting goods through the lock along a defined conveyor path, the improvements comprising the conveying means in the ascending leg of the U-shaped lock chamber comprising a vibratory conveyor having a helically ascending conveyor track.

2. In a lock according to claim 1, wherein the lock has a helically ascending lock chamber having a floor forming the conveyor track.

3. In a lock according to claim 2, wherein the lock chamber comprises a rectangular cross section.

4. In a lock according to claim 2, which has means for creating a flow of the inert fluid in the conveying direction in the lock chamber, said means for forming the flow including a circulating pump.

5. In a lock according to claim 2, wherein the helically ascending lock chamber is fastened to a centrally arranged carrying column.

6. In a lock according to claim 5, wherein the carrying column is connected to a vibrator.

7. In a lock according to claim 6, wherein the vibrator has an unbalanced drive.

8. In a lock according to claim 7, wherein the unbalanced drive comprises at least one flywheel having an adjustable eccentricity mounted on a shaft of a motor.

9. In a lock according to claim 2, wherein the helically ascending lock chamber is preceded by a gravity conveyor in the conveying direction.

10. In a lock according to claim 9, wherein the helically ascending lock chamber has an outlet connected to a gravity conveyor.

11. In a lock according to claim 2, wherein the helically ascending lock chamber has an input and an output with at least one of the inputs and outputs being connected to a gravity conveyor formed by a downpipe.

12. In a lock according to claim 11, wherein the gravity conveyor is closeable with a cover and has a portion lying below the liquid level in the lock chamber being filled with said liquid and a portion of the downpipe above said liquid being flooded with an inert gas.

13. In a lock according to claim 12, wherein the downpipe is connected to the helical lock chamber by a compenstor sleeve to enable relative motion therebetween.

14. In a lock according to claim 2, wherein a portion of the track is provided with a roughened surface to provide friction between the track and the goods being conveyed.

15. A lock according to claim 2, wherein the helically lock chamber has at least one cooling zone in a region above the liquid level of the liquid in said liquid lock chamber.

16. In a lock according to claim 15, wherein the cooling zone is formed by cooling pipes.

17. In a lock according to claim 1, which includes a tank, said vibratory conveyor being a separate conveyor track positioned in said tank.

18. In a lock according to claim 17, which includes means for creating a flow of inert fluid in the tank in the conveying direction and including a circulating pump.

19. In a lock according to claim 17, wherein said helical conveyor track is fastened to a centrally arranged carrier column, said column having a connection to a vibrator.

20. In a lock according to claim 19, wherein said vibrator includes an unbalanced drive.

21. In a lock according to claim 17, wherein said lock has a gravity conveyor discharging to a input end of the helical conveyor track and has a second gravity conveyor for receiving the goods discharged from the end of the helical conveyor track.

22. In a lock according to claim 21, wherein each of the gravity conveyors is formed by a downpipe.

23. In a lock according to claim 21, wherein each of the gravity conveyors is closeable at an end opposite the tank of the lock by a lid and has means for charging a portion of the gravity conveyor with an inert gas.

24. In a lock according to claim 17, wherein a portion of the conveyor track is provided with means forming a roughened surface to increase the friction between the goods and the conveyor track to facilitate transport of the goods thereon.

* * * * *